US011789478B2

(12) United States Patent
Deng et al.

(10) Patent No.: US 11,789,478 B2
(45) Date of Patent: Oct. 17, 2023

(54) VOLTAGE REGULATOR WITH SUPPLY NOISE CANCELLATION

(71) Applicant: CREDO TECHNOLOGY GROUP LTD, Grand Cayman (KY)

(72) Inventors: Zhicheng Deng, Sunnyvale, CA (US); Yida Duan, Fremont, CA (US)

(73) Assignee: Credo Technology Group Limited, Grand Cayman (KY)

( * ) Notice: Subject to any disclaimer, the term of this patent is extended or adjusted under 35 U.S.C. 154(b) by 0 days.

(21) Appl. No.: 17/652,065

(22) Filed: Feb. 22, 2022

(65) Prior Publication Data

US 2023/0266783 A1 Aug. 24, 2023

(51) Int. Cl.
*G05F 1/575* (2006.01)
*G05F 1/46* (2006.01)

(52) U.S. Cl.
CPC ..... *G05F 1/575* (2013.01); *G05F 1/467* (2013.01)

(58) Field of Classification Search
CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735
See application file for complete search history.

(56) References Cited

U.S. PATENT DOCUMENTS 4,908,566 A * 3/1990 Tesch ..... G05F 1/56 323/280

6,246,221 B1 * 6/2001 Xi ..... G05F 1/575 323/280

(Continued)

FOREIGN PATENT DOCUMENTS

CN 204576328 * 8/2015
CN 105955390 * 9/2016

(Continued)

OTHER PUBLICATIONS

Yang, B., Drost, B., Rao, S., & Hanumolu, P. K. (2011). A high-PSR LDO using a feedforward supply-noise cancellation technique. 2011 IEEE Custom Integrated Circuits Conference (CICC). doi:10.1109/cicc.2011.6055409.

(Continued)

*Primary Examiner* — Kevin J Comber
*Assistant Examiner* — Nusrat Quddus
(74) *Attorney, Agent, or Firm* — RAMEY LLP; Daniel J. Krueger

(57) ABSTRACT

Power supply noise reduction methods and low drop out (LDO) voltage regulators with capacitively coupled supply noise-reducing components are disclosed. One illustrative voltage regulator includes: a pass transistor having an n-type conduction channel that couples a supply voltage to an output node; an operational amplifier that derives a control signal for the pass transistor from a difference between a reference voltage and a scaled or unscaled voltage of the output node, the control signal being supplied to a gate or base of the pass transistor; a buffer that derives a ripple cancellation signal from the supply voltage; and a coupling capacitor that couples the buffer to the base or gate of the pass transistor to impose the ripple cancellation signal on the control signal.

20 Claims, 1 Drawing Sheet

(56) References Cited

U.S. PATENT DOCUMENTS 6,541,946 B1 * 4/2003 Chen ..... G05F 1/575 323/280
10,416,695 B1 * 9/2019 Bohannon ..... H03F 3/45192
10,845,834 B2 * 11/2020 Nedovic ..... G05F 1/467
2003/0111986 A1 * 6/2003 Xi ..... G05F 1/575 323/280
2004/0046532 A1 * 3/2004 Menegoli ..... G05F 3/262 323/273
2005/0225306 A1 * 10/2005 Oddoart ..... G05F 1/575 323/274
2005/0275394 A1 * 12/2005 Moraveji ..... G05F 1/565 323/312
2008/0303496 A1 * 12/2008 Schlueter ..... G05F 1/575 323/273
2009/0115382 A1 * 5/2009 Hasegawa ..... G05F 1/575 323/273
2010/0148736 A1 * 6/2010 Napravnik ..... G05F 1/575 323/280
2011/0193540 A1 * 8/2011 Dasgupta ..... H02M 1/15 323/282
2011/0299202 A1 * 12/2011 Cai ..... H02H 9/046 361/56
2013/0099764 A1 * 4/2013 Zhang ..... G05F 1/575 323/273
2014/0253057 A1 * 9/2014 Guhados ..... G05F 1/625 323/268
2014/0340058 A1 * 11/2014 Wang ..... H02M 1/15 323/268
2016/0173066 A1 * 6/2016 Yang ..... H03K 19/01714 327/109
2016/0195883 A1 * 7/2016 Aboudina ..... G05F 1/575 323/280
2016/0334818 A1 * 11/2016 Singh ..... G05F 1/56
2017/0038783 A1 * 2/2017 Chen ..... G05F 1/46
2017/0060153 A1 * 3/2017 Kadanka ..... G05F 1/575
2017/0097649 A1 * 4/2017 Lee ..... G09G 3/3696
2017/0194855 A1 * 7/2017 Petenyi ..... G05F 1/625
2018/0017982 A1 * 1/2018 Song ..... G05F 1/575
2018/0284829 A1 * 10/2018 Hussien ..... H02P 9/30
2021/0021270 A1 * 1/2021 Zhan ..... G05F 1/561
2021/0303014 A1 * 9/2021 Migliavacca ..... G05F 1/575
2022/0011798 A1 * 1/2022 Matyscak ..... G05F 1/565

FOREIGN PATENT DOCUMENTS

CN 106774575 * 5/2017
CN 108345341 * 7/2018
CN 208424340 * 1/2019
CN 110502053 * 12/2020

OTHER PUBLICATIONS

El-Nozahi M., at al., "High PSR Low Drop-Out Regulator With Feed-Forward Ripple Cancellation Technique", IEE USSC, vol. 45, No. 3, pp. 565-577, Mar. 2010.

Bramble, S., & Alonso, G. (n.d.). Loop gain and its effect on analog control systems. Analog Devices. Retrieved Nov. 16, 2022, from https://www.analog.com/en/technical-articles/loop-gain-and-its-effect-on-analog-control-systems.html.

FET Common Drain / Source Follower. Electronics Notes. (n.d.). Retrieved Nov. 16, 2022, from https://www.electronics-notes.com/articles/analogue_circuits/fet-field-effect-transistor/common-drain-source-follower-circuit.php#:~:text=The%20common%20drain%20or%20source,act%20as%20a%20buffer%20amplifier.&text=The%20like%20the%20transistor%20emitter,and%20a%20high%20input%20impedance.

Noise coupling suppression techniques for your circuits. Cadence System Analysis. (Oct. 13, 2022). Retrieved Nov. 16, 2022, from https://resources.system-analysis.cadence.com/blog/msa2021-noise-coupling-suppression-techniques-for-your-circuits.

* cited by examiner

VOLTAGE REGULATOR WITH SUPPLY NOISE CANCELLATION

BACKGROUND

Most integrated circuit devices have become so complex that it is impractical for electronic device designers to design them from scratch. Instead, electronic device designers rely on predefined modular units of integrated circuit layout designs, arranging and joining them as needed to implement the various functions of the desired device. Each modular unit has a defined interface and behavior that has been verified by its creator. Though each modular unit may take a lot of time and investment to create, its availability for re-use and further development cuts product cycle times dramatically and enables better products. The predefined units can be organized hierarchically, with a given unit incorporating one or more lower-level units and in turn being incorporated within higher-level units. Many organizations have libraries of such predefined modular units for sale or license, including, e.g., embedded processors, memory, interfaces for different bus standards, power converters, frequency multipliers, sensor transducer interfaces, to name just a few. The predefined modular units are also known as cells, blocks, cores, and macros, terms which have different connotations and variations ("IP core", "soft macro") but are frequently employed interchangeably.

The modular units can be expressed in different ways, e.g., in the form of a hardware description language (HDL) file, or as a fully-routed design that could be printed directly to a series of manufacturing process masks. Fully-routed design files are typically process-specific, meaning that additional design effort would usually be needed to migrate the modular unit to a different process or manufacturer. Conversely, modular units in HDL form require subsequent synthesis, placement, and routing steps for implementation, but are process-independent, meaning that different manufacturers can apply their preferred automated synthesis, placement, and routing processes to implement the units using a wide range of manufacturing processes. By virtue of their higher-level representation, HDL units may be more amenable to modification and the use of variable design parameters, whereas fully-routed units may offer better predictability in terms of areal requirements, reliability, and performance. While there is no fixed rule, digital module designs are more commonly specified in HDL form, while analog and mixed-signal units are more commonly specified as a lower-level, physical description.

Many modular units, such as high bandwidth serializer/deserializer (SerDes) modules, are sensitive to power supply noise. Such noise, which often results from signal transitions in high bandwidth circuitry, increases jitter in transmitted signals and receiver clocks and influences the operation of amplifiers used for equalization and symbol decisions. Though there exist various techniques for limiting power supply noise to acceptable levels, they are overly complex, power hungry, or simply infeasible for use as part of a predefined modular unit.

SUMMARY

Accordingly, there are disclosed herein power supply noise reduction methods and low drop out (LDO) voltage regulators with capacitively coupled supply noise-reducing components. One illustrative voltage regulator includes: a pass transistor having an n-type conduction channel that couples a supply voltage to an output node; an operational amplifier that derives a control signal for the pass transistor from a difference between a reference voltage and a scaled or unscaled voltage of the output node, the control signal being supplied to a gate or base of the pass transistor; a buffer that derives a ripple cancellation signal from the supply voltage; and a coupling capacitor that couples the buffer to the base or gate of the pass transistor to impose the ripple cancellation signal on the control signal.

An illustrative voltage regulation method includes: coupling a supply voltage to an output node using a pass transistor having an n-type conduction channel; using an operational amplifier to derive a control signal for the pass transistor from a difference between a reference voltage and a scaled or unscaled voltage of the output node; deriving a ripple cancellation signal from the supply voltage with a buffer; supplying the control signal to a gate or base of the pass transistor; and imposing the ripple cancellation signal on the control signal via a coupling capacitor that couples the buffer to the base or gate of the pass transistor.

An illustrative computer-readable information storage medium stores a hardware description language (HDL) design of a low drop out (LDO) voltage regulation circuit, the design specifying: a pass transistor having an n-type conduction channel that couples a supply voltage to an output node; an operational amplifier that derives a control signal for the pass transistor from a difference between a reference voltage and a scaled or unscaled voltage of the output node, the control signal being supplied to a gate or base of the pass transistor; a buffer that derives a ripple cancellation signal from the supply voltage; and a coupling capacitor that couples the buffer to the base or gate of the pass transistor to impose the ripple cancellation signal on the control signal.

Each of the foregoing regulator, method, and design, may be implemented individually or conjointly, together with any one or more of the following features in any suitable combination: 1. a feedforward capacitor coupling the supply voltage to an input of the buffer. 2. a bias voltage is supplied to the input of the buffer via a feedforward resistor. 3. the feedforward resistor and feedforward capacitor jointly act as a high pass filter. 4. the pass transistor is an n-type metal oxide semiconductor (NMOS) transistor. 5. the buffer is an inverting buffer comprising a first NMOS transistor in series with a second NMOS transistor, the first NMOS transistor having a fixed bias and the second NMOS transistor having a gate capacitively coupled to the supply voltage to generate the ripple cancellation signal on an intermediate node between the first and second NMOS transistors. 6. the buffer has a gain of about minus one. 7. the pass transistor has a gate capacitance and a ratio of the gate capacitance to the coupling capacitance determines a scaling factor for the ripple cancellation signal. 8. a resistive voltage divider that provides the scaled voltage of the output node to an inverting node of the operational amplifier.

DETAILED DESCRIPTION

Figure 1:
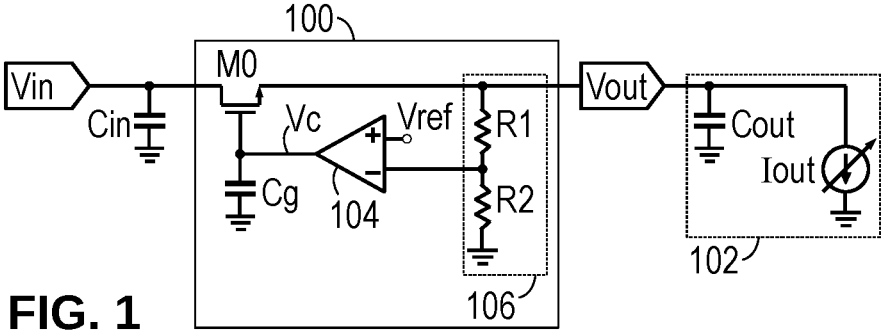
FIG. 1 is a schematic of an illustrative low drop out (LDO) voltage regulator circuit.

Note that the specific embodiments given in the drawings and following description do not limit the disclosure. On the contrary, they provide the foundation for one of ordinary skill to discern the alternative forms, equivalents, and modifications that are encompassed in the claim scope.

FIG. 1 shows a voltage regulator circuit 100, which may be a circuit block specified in the form of an HDL design and implemented as an integrated circuit on a semiconducting substrate. The voltage regulator circuit 100 is a low dropout (LDO) voltage regulator, and as such, it includes a pass transistor M0 coupling a power supply voltage $V_{IN}$ to a regulated voltage node $V_{OUT}$ for powering a load circuit 102. The load circuit is represented here as an output capacitance $C_{OUT}$ and a variable current sink $I_{OUT}$ that consumes power from the regulated voltage node $V_{OUT}$. For SerDes modules, it is desired to maintain the regulated voltage $V_{OUT}$ at a constant value even as the current draw varies from nearly zero to hundreds of milliamps.

Pass transistor M0 is an n-channel metal oxide semiconductor (NMOS) transistor, having a gate that receives a control signal $V_C$ from operational amplifier 104. The operational amplifier 104 receives a reference voltage $V_{REF}$ at its non-inverting input $V_+$ and an unscaled or scaled version of the regulated voltage $V_{OUT}$ at its inverting input $V_-$, amplifying the difference between the two to drive the gate of the pass transistor M0. There are many suitable ways to generate the reference voltage $V_{REF}$ available in the academic literature, though a bandgap voltage reference may be preferred due to stability and ease of implementation.

As such reference voltages are typically a fraction of the desired regulated voltage $V_{OUT}$, a resistive voltage divider 106 may be used for scaling. Voltage divider 106 supplies a scaled voltage $V_{OUT}*R_2/(R_1+R_2)$ to the inverting input $V_-$ of operational amplifier 104. So long as the supply voltage $V_{IN}$ sufficiently exceeds the desired voltage $V_{OUT}$, amplifier 104 provides negative feedback, raising the control signal voltage $V_C$ (and regulated voltage $V_{OUT}$) when the inverting input voltage $V_-$ is less than noninverting input voltage $V_+$ and lowering the control signal voltage (and $V_{OUT}$) when the inverting input voltage $V_-$ is greater than noninverting input voltage $V_+$. In this fashion, amplifier 104 forces the difference between its input terminals to zero, thereby setting $V_{OUT}=V_{REF}*(R_1+R_2)/R_2$.

Ideally, the regulated voltage $V_{OUT}$ is independent of the supply voltage $V_{IN}$, and so long as the supply voltage's rate of variation does not exceed the amplifier's ability to adjust the control voltage, the performance is close to ideal. However, the pass transistor's inherent gate capacitance $C_G$ combines with the amplifier's output conductance to impose an upper limit on the rate of variation that can be corrected and thus an upper limit on the noise frequencies that can be suppressed.

It should be noted, however, that an intrinsic input capacitance (possibly augmented with a discrete or integrated input capacitor) $C_{IN}$ cooperates with the power supply impedance to act as a low pass filter that suppresses power supply noise above a certain cutoff frequency. For feasible combinations of input capacitance and supply impedance, this cutoff frequency is well above the upper limit that amplifier 104 can cope with. These two frequencies define an intermediate of noise frequencies that can leak through the illustrative voltage regulator to cause undesired variation in the regulated voltage $V_{OUT}$. As one example, the range of intermediate frequencies is 2 megahertz to 10 megahertz for certain contemplated voltage regulator embodiments.

Figure 2:
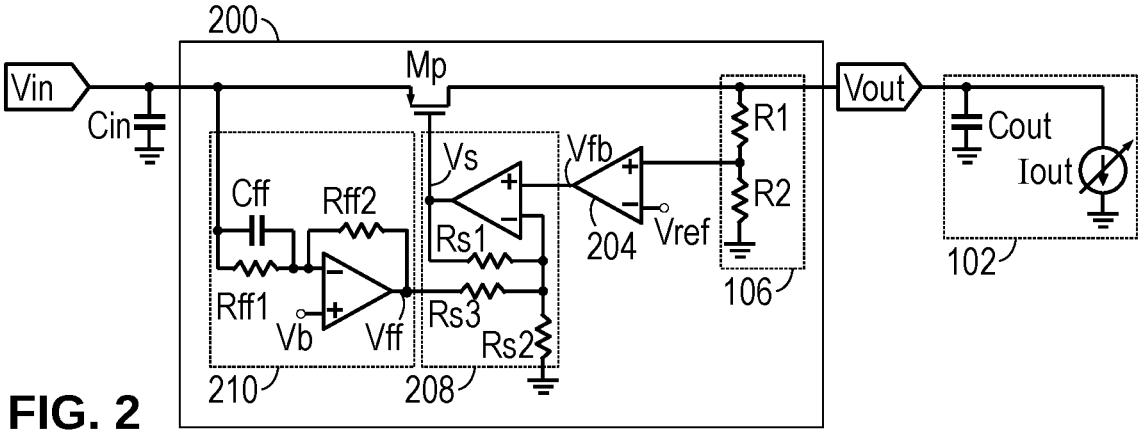
FIG. 2 is a schematic of a relatively complex voltage regulator circuit.

FIG. 2 shows an illustrative voltage regulator circuit 200 having added complexity to improve suppression of intermediate noise frequencies. Unlike voltage regulator circuit 100, voltage regulator circuit 200 employs a p-channel metal oxide semiconductor (PMOS) transistor as its pass transistor $M_P$. (NMOS transistors conduct better for higher voltages whereas PMOS transistors conduct better for lower voltages.) To enable negative feedback for the PMOS pass transistor $M_P$, the reference voltage $V_{REF}$ is provided to the inverting input $V_-$ of operational amplifier 204, while the scaled output voltage $V_{OUT}*R_2/(R_1+R_2)$ is provided to the non-inverting input $V_+$. Amplifier 204 amplifies the difference between $V_+$ and $V_-$ to provide the feedback signal $V_{FB}$.

A summing amplifier 208 combines the feedback signal $V_{FB}$ with a feed forward signal $V_{FF}$ to produce supply a control signal Vs to the gate of pass transistor $M_P$. The control signal Vs is expressible as $$V_S = \left(1 + \frac{R_{S1}}{R_{S2}} + \frac{R_{S1}}{R_{S3}}\right)V_{FB} - \frac{R_{S1}}{R_{S3}}V_{FF}.$$

A feed forward amplifier 210 produces the feed forward signal $V_{FF}$, which is expressible as $$V_{FF} = V_B + (V_B - V_{IN})R_{FF2}\left(\frac{1}{R_{FF1}} + j\omega C_{FF}\right).$$

The feed forward amplifier acts as a high pass filter for frequencies in excess of approximately $1/2\pi R_{FF1}C_{FF}$, which can be chosen so that the feed forward signal $V_{FF}$ represents the middle-frequency noise components of the supply voltage. The resistances of the summing amplifier 208 enable the control voltage to suppress these noise components from the regulated voltage $V_{OUT}$.

The use of two additional operational amplifiers and their supporting components significantly increases circuit complexity, consuming more area, more power, and necessitating careful calibration for correct performance. The use of a PMOS pass transistor $M_P$, which relies on reduced-mobility charge carriers, further limits the efficiency and performance of regulator circuit 200.

Figure 3:
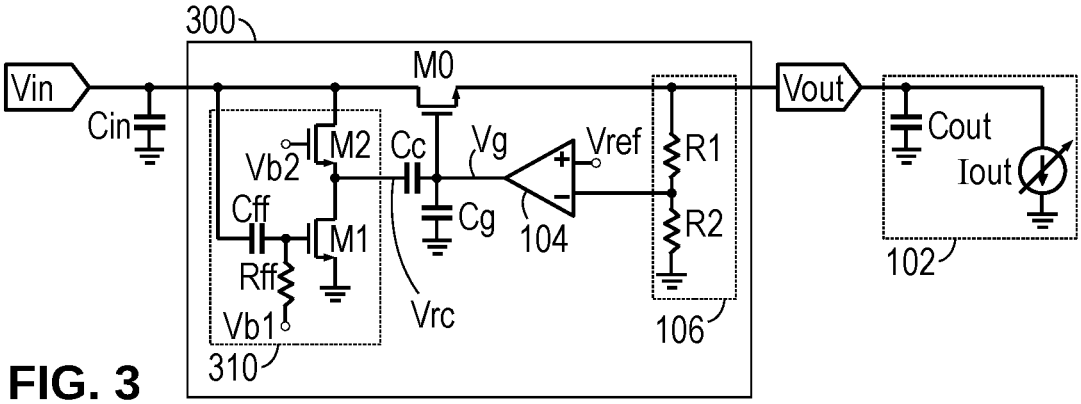
FIG. 3 is a schematic of an illustrative voltage regulator circuit having capacitively coupled supply noise cancellation.

In contrast, the illustrative voltage regulator circuit 300 of FIG. 3 retains most of the simplicity of circuit 100, adding only an inverting buffer 310 with AC-coupling capacitors $C_{FF}$ and $C_C$. The inverting buffer 310 is implementable as two NMOS transistors M1, M2, in series. Transistor M1 is coupled between ground and an intermediate node, while transistor M2 is coupled between the intermediate node and supply voltage $V_{IN}$. A bias voltage $V_{B2}$ is coupled to the gate of transistor M2, causing it to act essentially as a constant current source. A resistor $R_{FF}$ couples a corresponding bias voltage $V_{B1}$ to the gate of transistor M1 so that in the absence of supply voltage variations, M1 acts as a current sink matched to the constant current source M2.

Coupling capacitor $C_{FF}$ couples variations of the supply voltage $V_{IN}$ to the gate of current sink transistor M1, producing a ripple cancellation signal voltage $V_{RC}$ on the intermediate node. Coupling capacitor $C_{FF}$ combines with resistor $R_{FF}$ to act as a high pass filter. For supply voltage variations having frequencies above $1/2\pi R_{FF}C_{FF}$, the cancellation signal voltage $V_{RC}$ includes negative variations at the corresponding frequencies. Inverting buffer 310 can be configured to provide a gain of −1 for the range of intermediate noise frequencies described above. Coupling capacitor $C_C$ and gate capacitance $C_G$ can act as an impedance voltage divider, scaling the cancellation signal $V_{RC}$ by $1/(1+C_G/C_C)$. The gate voltage of pass transistor M0 is the control signal $V_C$ (see FIG. 1) with a superimposed scaled cancellation signal $V_{RC}$:

$$V_G = V_C + \frac{V_{RC}}{1 + \frac{C_G}{C_C}}$$

The coupling capacitance $C_C$ is accordingly chosen to match the negative variations of the cancellation signal voltage with the corresponding supply voltage variations in the intermediate noise frequency range.

In this fashion, the illustrated regulator directly subtracts the supply voltage noise from the regulated voltage, substantially improving the power supply rejection ratio (PSRR) at intermediate noise frequencies, leading to significantly reduced jitter and reduced bit error rates in SerDes modules using the illustrated voltage regulator. The use of capacitive coupling and inverting buffer greatly reduces complexity, area, and power consumption as compared with the regulator circuit 200 (FIG. 2).

Numerous alternative forms, equivalents, and modifications will become apparent to those skilled in the art once the above disclosure is fully appreciated. For example, voltage regulator circuit 300 is implemented using NMOS transistors, but those familiar with the art will recognize how the disclosed principles can be used with other semiconductor technologies including PMOS, CMOS, JFET, and BJT. It is intended that the claims be interpreted to embrace all such alternative forms, equivalents, and modifications that are encompassed in the scope of the appended claims

What is claimed is:

1. A low drop-out (LDO) voltage regulation circuit that comprises:

a pass transistor having an n-type conduction channel that couples a supply voltage to an output node;

an operational amplifier that derives a control signal for the pass transistor from a difference between a reference voltage and a scaled or unscaled voltage of the output node, the control signal being supplied to a gate or base of the pass transistor;

a buffer that derives a ripple cancellation signal from the supply voltage; and a coupling capacitor having a first terminal connected to an output of the buffer and a second terminal directly connected to the base or gate of the pass transistor to impose the ripple cancellation signal on the control signal.

2. The circuit of claim 1, further comprising a feedforward capacitor coupling the supply voltage to an input of the buffer.

3. The circuit of claim 2, wherein a bias voltage is supplied to the input of the buffer via a feedforward resistor, and wherein the feedforward resistor and feedforward capacitor jointly act as a high pass filter.

4. The circuit of claim 1, wherein the pass transistor is an n-type metal oxide semiconductor (NMOS) transistor.

5. The circuit of claim 4, wherein the buffer is an inverting buffer comprising a first NMOS transistor in series with a second NMOS transistor, the first NMOS transistor having a fixed bias and the second NMOS transistor having a gate capacitively coupled to the supply voltage to generate the ripple cancellation signal on an intermediate node between the first and second NMOS transistors.

6. The circuit of claim 4, wherein the pass transistor has a gate capacitance, wherein the buffer has a gain of about minus one, and wherein a ratio of the gate capacitance to the coupling capacitor determines a scaling factor for the ripple cancellation signal.

7. The circuit of claim 1, further comprising a resistive voltage divider that provides the scaled voltage of the output node to an inverting node of the operational amplifier.

8. A low drop-out (LDO) voltage regulation method that comprises:

coupling a supply voltage to an output node using a pass transistor having an n-type conduction channel;

using an operational amplifier to derive a control signal for the pass transistor from a difference between a reference voltage and a scaled or unscaled voltage of the output node;

deriving a ripple cancellation signal from the supply voltage with a buffer;

supplying the control signal to a gate or base of the pass transistor; and imposing the ripple cancellation signal on the control signal via a coupling capacitor having a first terminal connected to an output of the buffer and a second terminal connected to the base or gate of the pass transistor.

9. The method of claim 8, further comprising: capacitively coupling the supply voltage to an input of the buffer with a feedforward capacitor.

10. The method of claim 9, further comprising: supplying a bias voltage to the input of the buffer via a feedforward resistor, wherein the feedforward resistor and feedforward capacitor jointly act as a high pass filter.

11. The method of claim 8, wherein the pass transistor is an n-type metal oxide semiconductor (NMOS) transistor.

12. The method of claim 11, wherein the buffer is an inverting buffer comprising a first NMOS transistor in series with a second NMOS transistor, the first NMOS transistor having a fixed bias and the second NMOS transistor having a gate capacitively coupled to the supply voltage to generate the ripple cancellation signal on an intermediate node between the first and second NMOS transistors.

13. The method of claim 11, wherein the pass transistor has a gate capacitance, wherein the buffer has a gain of about minus one, and wherein a ratio of the gate capacitance to the coupling capacitor determines a scaling factor for the ripple cancellation signal.

14. The method of claim 8, further comprising using a resistive voltage divider to provide the scaled voltage of the output node to an inverting node of the operational amplifier.

15. A computer-readable information storage medium that stores a hardware description language design of a low drop-out (LDO) voltage regulation circuit, the design specifying:

a pass transistor having an n-type conduction channel that couples a supply voltage to an output node;

an operational amplifier that derives a control signal for the pass transistor from a difference between a reference voltage and a scaled or unscaled voltage of the output node, the control signal being supplied to a gate or base of the pass transistor;

a buffer that derives a ripple cancellation signal from the supply voltage; and a coupling capacitor having a first terminal connected to an output of the buffer and a second terminal connected to the base or gate of the pass transistor to impose the ripple cancellation signal on the control signal.

16. The medium of claim 15, wherein the design further specifies a feedforward capacitor coupling the supply voltage to an input of the buffer.

17. The medium of claim 16, wherein the design further specifies a feedforward resistor to supply a bias voltage the input of the buffer via a feedforward resistor, and wherein the feedforward resistor and feedforward capacitor jointly act as a high pass filter.

18. The medium of claim 15, wherein the pass transistor is an n-type metal oxide semiconductor (NMOS) transistor.

19. The medium of claim 18, wherein the buffer is an inverting buffer comprising a first NMOS transistor in series with a second NMOS transistor, the first NMOS transistor having a fixed bias and the second NMOS transistor having a gate capacitively coupled to the supply voltage to generate the ripple cancellation signal on an intermediate node between the first and second NMOS transistors.

20. The medium of claim 18, wherein the pass transistor has a gate capacitance, wherein the buffer has a gain of about minus one, and wherein a ratio of the gate capacitance to the coupling capacitor determines a scaling factor for the ripple cancellation signal.

* * * * *